US011614293B2

(12) United States Patent
Elftmann, Jr.

(10) Patent No.: US 11,614,293 B2
(45) **Date of Patent: *Mar. 28, 2023**

(54) TRIGGER SECURING APPARATUS

(71) Applicant: Arthur Joseph Elftmann, Jr., Glendale, AZ (US)

(72) Inventor: Arthur Joseph Elftmann, Jr., Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/572,979

(22) Filed: Jan. 11, 2022

(65) Prior Publication Data

US 2022/0136792 A1 May 5, 2022

Related U.S. Application Data

(63) Continuation of application No. 17/011,999, filed on Sep. 3, 2020, now Pat. No. 11,262,149.

(60) Provisional application No. 62/895,935, filed on Sep. 4, 2019.

(51) Int. Cl.

| | |
|---|---|
| ***F41A 19/10*** | (2006.01) |
| ***F41A 19/14*** | (2006.01) |
| ***F41A 19/15*** | (2006.01) |

(52) U.S. Cl.

CPC ..... *F41A 19/10* (2013.01); *F41A 19/14* (2013.01); *F41A 19/15* (2013.01)

(58) Field of Classification Search

CPC ..... F41A 19/10; F41A 19/14; F41A 19/15

See application file for complete search history.

(56) References Cited

U.S. PATENT DOCUMENTS

| | | | | |
|---|---|---|---|---|
| 7,150,121 | B1 | 12/2006 | Clay | |
| 9,046,313 | B1 | 6/2015 | Lutton | |
| 9,733,031 | B1 * | 8/2017 | Sylvester | F41A 3/66 |
| 2017/0299323 | A1 | 10/2017 | Nachefski | |

* cited by examiner

*Primary Examiner* — J. Woodrow Eldred

(74) *Attorney, Agent, or Firm* — The Law Offices of Lisa & Lesko, LLC; Justin J. Lesko, Esq.

(57) ABSTRACT

Trigger module securing apparatus using internally threaded pins and threaded fasteners to secure a trigger module into the lower receiver of a rifle.

4 Claims, 3 Drawing Sheets

TRIGGER SECURING APPARATUS

CROSS REFERENCE TO RELATED APPLICATION

This application is a continuation of application Ser. No. 17/011,999, filed Sep. 3, 2020, which claims the benefit of provisional Application 62/895,935, filed Sep. 4, 2019. Each of those earlier filed applications is hereby incorporated by reference in its entirety.

BACKGROUND OF THE INVENTION

Field of the Invention

This invention is a threaded bushing component set for use in securing a trigger assembly in the lower receiver of a rifle.

Description of Known Art

Earlier trigger retention systems known to the inventor did not include the use of a threaded bushing as presented herein. In existing systems pins are used to secure the trigger into the lower of a rifle. The pins may be retained by a clip that holds the pins in place.

BRIEF SUMMARY OF THE INVENTION

The present invention provides a secure mounting of a removable trigger assembly in the lower receiver of a rifle.

Another advantage is that a person or persons assembling a rifle from component parts can fit this device in the lower receiver that she or he is using for the assembly without a need to have a special lower receiver or special machining to accommodate this threaded bushing component to secure the trigger assembly in the "lower."

One advantage of the invention is that the threaded bushing system eliminates the need for a pin retention clip to hold separate pins in place in the lower receiver of a rifle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶ 6. Moreover, even if the provisions of 35 U.S.C. § 112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWING

A more complete understanding of the present invention may be derived by referring to the detailed description when considered in connection with the drawing figures wherein.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

As mentioned above, this invention has to do with rifles and particularly the removable trigger assembly carried in the lower receiver of a rifle. The threaded bushings of the invention may augment retention apparatus of trigger assemblies. In known similar trigger mounting systems pins and pin retention clips are used to secure the trigger components in the lower receiver.

Figure 1:
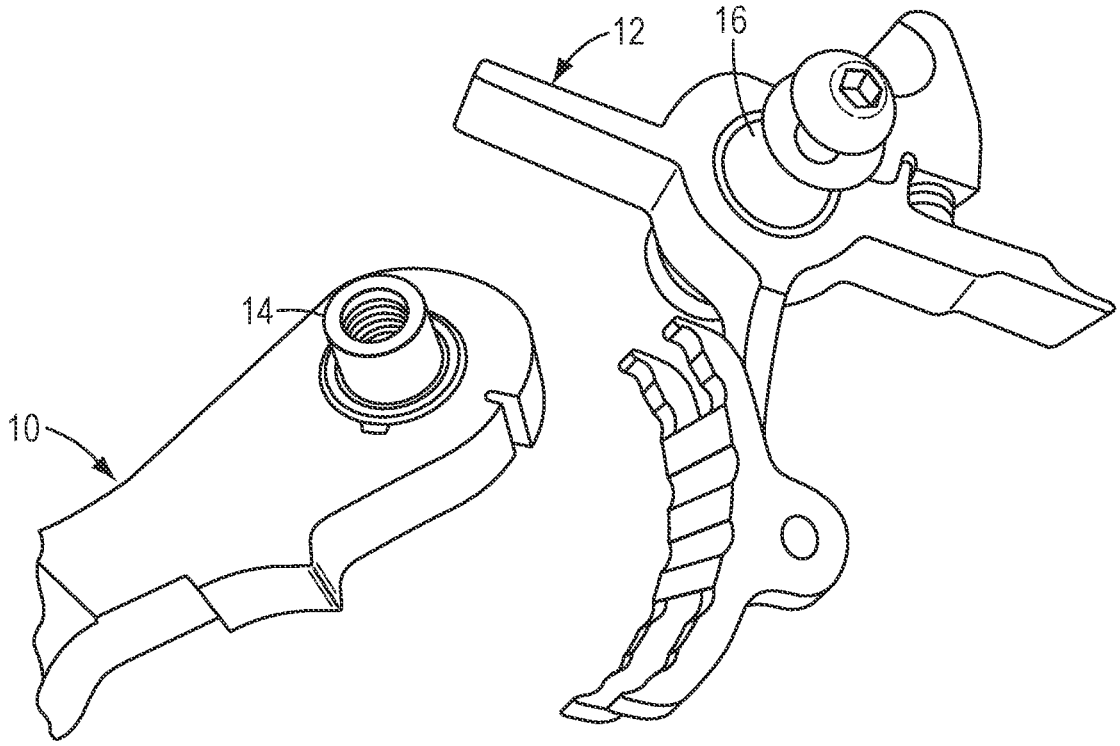
FIG. 1 shows a trigger and a hammer with the threaded bushings installed in the hammer and in the trigger assembly.

FIG. 1 is a picture of a trigger and of a hammer with the threaded bushings installed in the trigger and in the hammer assembly respectively. In this figure a portion of a hammer, generally 10, and a trigger assembly, generally 12 are shown. These two elements interface when assembled in a trigger module as is well known. The hammer 10 is carried in a trigger assembly in a rotatable configuration so the hammer will rotate on a pin carried in and through an aperture in the hammer body. In the embodiment shown in FIG. 1 the pivoting element is a threaded bushing 14. The threads in the bushing are clearly visible in the figure.

The trigger 12 also is pivotably carried in the trigger assembly housing. In this invention there is a threaded bushing 16 carried in an aperture of the trigger at the usual pivot location of the trigger as well known in the art. The threaded bushing 16 in the trigger and the threaded bushing 14 in the hammer are not used on modular trigger assemblies for rifles as far as the inventor knows.

Figure 2:
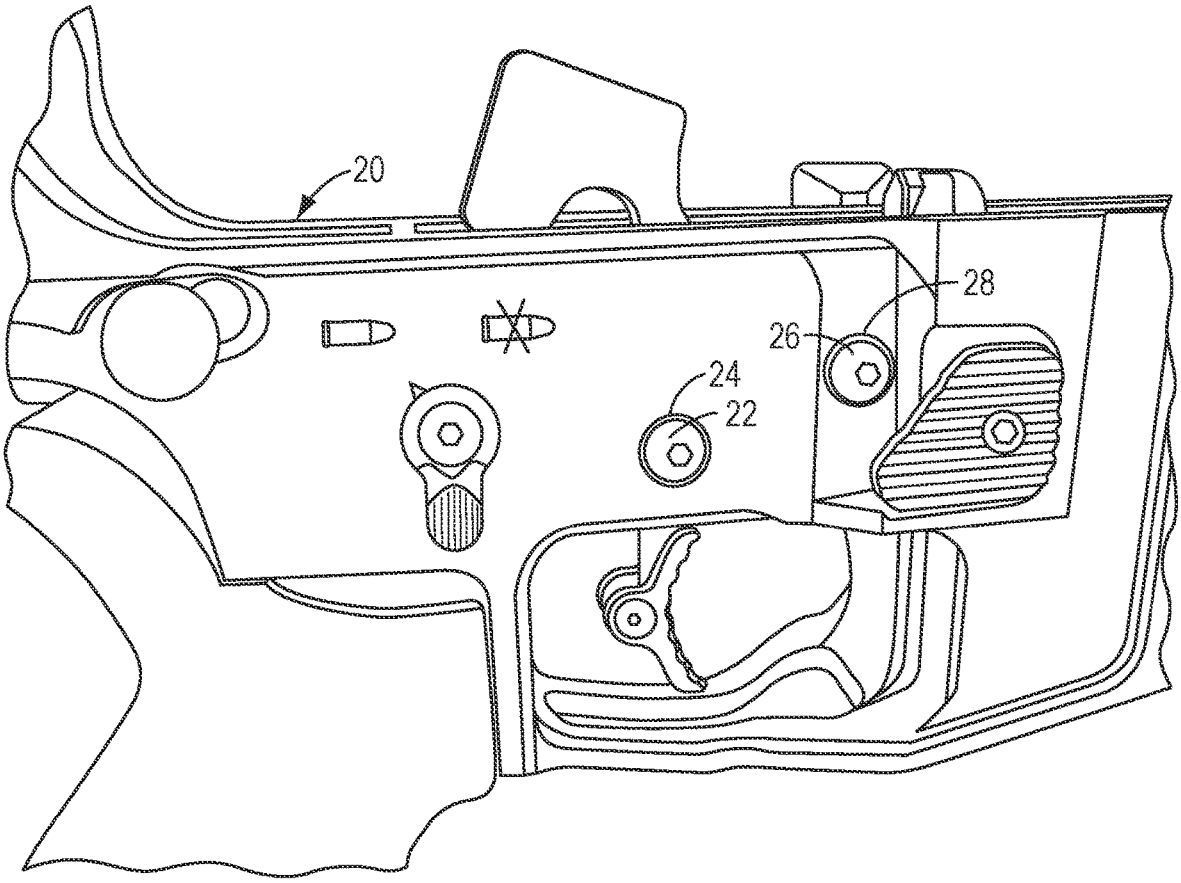
FIG. 2 is a right-side view of a rifle showing the retainer screws for the trigger and the hammer being used with the threaded bushings.

FIG. 2 is a right-side view of a portion of a lower receiver, generally 20, of a rifle showing the retainer screws for the trigger and the hammer being used with the threaded bushings. The right-side retaining screw 22 for the trigger captures a right-side retaining screw washer 24 between the head of the screw and the right-side body of the lower receiver 20. Similarly, a right-side retaining screw 26 for the hammer captures a right-side retaining screw washer between the head of the right side retaining screw 26 for the hammer and the right side of the body of the lower receiver 20.

Figure 3:
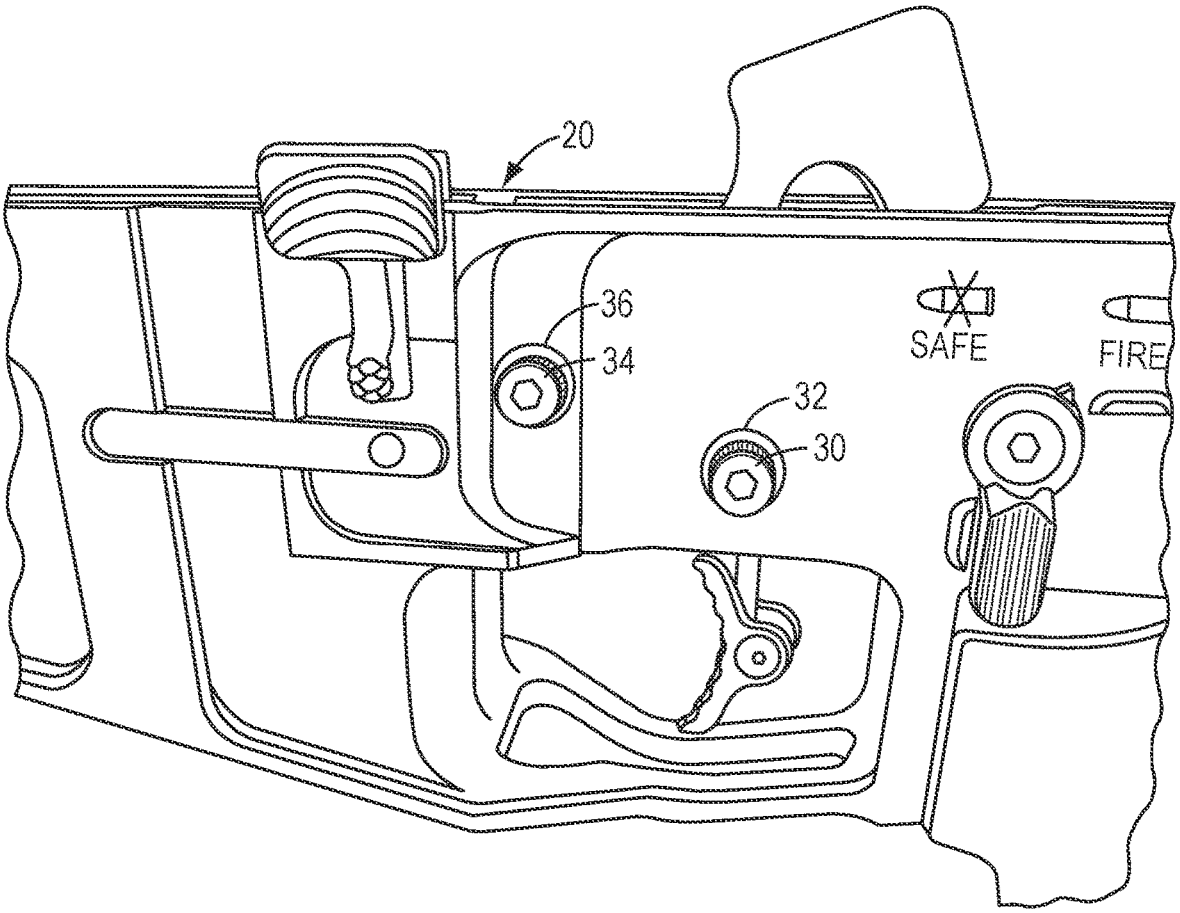
FIG. 3 is a left side view of a rifle showing the retainer screws for the trigger and the hammer being used with the threaded bushings.

FIG. 3 is a left side view of a rifle showing the retainer screws for the trigger and the hammer being used with the threaded bushings. Looking at the left side of the lower receiver 20 there are similar threaded bushing retainers. Specifically, the left side retaining screw 30 for the trigger is shown as is the washer 32 for that screw location. A left side retaining screw 34 and its washer 34 are threaded into the threaded bushing 16 in FIG. 1.

All the retaining screws thread into the threaded bushings. There is a threaded bushing for the hammer and a threaded bushing for the trigger assembly.

In summary the invention herein is a trigger module comprising a hammer and a trigger. The threaded retention elements for the trigger and the hammer are usually used together in a single trigger module. It may be that the retention elements are used separately, i.e. only a hammer unit is provided with the threaded retention element or only a trigger is provided with the threaded device. To cover the situation where only a hammer threaded retention device is used, the trigger module will have a hammer with an aperture formed therein; a rotatable hammer element, having a diameter, the rotatable hammer element carried in and through the aperture of the hammer; and the rotatable element is a threaded bushing.

As there will usually be threaded fasteners threaded into each end of the threaded bushing, one from each end of the threaded bushing, the first threaded hammer fastener is threaded into the threaded bushing from a first direction. A second threaded hammer fastener is threaded into the threaded bushing from a direction opposite the direction the first threaded hammer fastener as is shown in FIGS. 2 and 3.

In addition to the elements mentioned above there may be a first intermediate interface hammer element carried in the aperture of the hammer. This first intermediate interface hammer element, including a first intermediate hammer element aperture will have a diameter similar to the diameter of the hammer rotatable element. The hammer rotatable element is carried in the first intermediate interface hammer element.

To help secure the trigger assembly to the lower of a rifle a second threaded hammer fastener is threaded into the aforementioned threaded bushing from a direction opposite the direction the first threaded hammer fastener.

The paragraphs above relate to the hammer of the trigger. A similar arrangement is used to secure a trigger in a trigger module. That is the trigger module has the expected trigger with an aperture formed therein; to accommodate a rotatable trigger element, also having a diameter, carried in and through the aperture of the trigger. The rotatable trigger element is a threaded bushing.

Like in the hammer there is a first threaded trigger fastener threaded into the threaded bushing from a first direction and a second threaded trigger fastener threaded into the threaded bushing from a direction opposite the direction the first threaded trigger fastener.

Again, as with the hammer structure, there is a similar first intermediate interface trigger element carried in the aperture of the trigger. This first intermediate interface trigger element includes a first intermediate trigger element aperture having a diameter similar to the diameter of the trigger rotatable element. The trigger rotatable element is carried in the first intermediate interface trigger element.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments defines or constrains the invention.

What is claimed is:

1. A trigger module comprising:

a hammer assembly having an aperture formed therein, wherein the aperture of the hammer assembly is configured to act as an axis upon which the hammer assembly rotates within a weapon;

a threaded bushing carried through the aperture of the hammer assembly, wherein:

(1) a first side of the threaded bushing is configured to mate with a first threaded fastener to securely fasten the hammer assembly to a first side of the weapon; and (2) a second side of the threaded bushing is configured to mate with a second threaded fastener to securely fasten the hammer assembly to a second side of the weapon.

2. The trigger module of claim 1 further comprising a bearing carried through the aperture of the hammer assembly, wherein the threaded bushing fits inside of the bearing.

3. The trigger module of claim 1 further comprising:

a trigger assembly having an aperture formed therein, wherein the aperture of the trigger assembly is configured to act as an axis upon which the trigger assembly rotates within a weapon;

a second threaded bushing carried through the aperture of the trigger assembly, wherein:

(1) a first side of the second threaded bushing is configured to mate with a third threaded fastener to securely fasten the trigger assembly to the first side of the weapon;

(2) a second side of the second threaded bushing is configured to mate with a fourth threaded fastener to securely fasten the trigger assembly to the second side of the weapon.

4. A trigger module comprising:

a trigger assembly having an aperture formed therein, wherein the aperture of the trigger assembly is configured to act as an axis upon which the trigger assembly rotates within a weapon;

a threaded bushing carried through the aperture of the trigger assembly, wherein:

(1) a first side of the threaded bushing is configured to mate with a first threaded fastener to securely fasten the trigger assembly to a first side of the weapon; and (2) a second side of the threaded bushing is configured to mate with a second threaded fastener to securely fasten the trigger assembly to a second side of the weapon.

* * * * *